US006808241B2

(12) United States Patent
Mackenzie et al.

(10) Patent No.: US 6,808,241 B2
(45) Date of Patent: Oct. 26, 2004

(54) FLUID EJECTION DEVICE

(75) Inventors: Mark H. Mackenzie, Corvallis, OR (US); Joseph M. Torgerson, Corvallis, OR (US); Michael D. Miller, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/387,149

(22) Filed: Mar. 11, 2003

(65) Prior Publication Data

US 2004/0179065 A1 Sep. 16, 2004

(51) Int. Cl.[7] ..... B41J 29/38; B41J 2/14; B41J 2/16; B41J 2/05

(52) U.S. Cl. ..... 347/9; 347/15; 347/47; 347/56; 347/58; 347/65

(58) Field of Search ..... 347/15, 48, 9, 347/47, 56, 58, 65

(56) References Cited

U.S. PATENT DOCUMENTS 6,079,811 A 6/2000 Cornell et al.
6,169,556 B1 1/2001 Koitabashi et al.
6,354,694 B1 3/2002 Weber et al.
6,390,600 B1 5/2002 Vega et al.
6,402,283 B2 6/2002 Schulte
6,439,691 B1 8/2002 Lee et al.
6,447,088 B2 * 9/2002 Tachihara et al. ..... 347/15

* cited by examiner

*Primary Examiner*—Michael S. Brooke

(57) ABSTRACT

In one embodiment, the present invention recites a fluid ejection device comprising a first drop ejector associated with a firing chamber. The first drop ejector is configured to cause fluid having a first drop weight to be ejected from the firing chamber, wherein the first drop ejector includes a first heating element and first drive circuitry electrically coupled with the first heating element. The present embodiment further comprises a first bore disposed within an orifice layer disposed proximate the first drop ejector and associated with the first drop ejector. The present embodiment also comprises a second drop ejector associated with the firing chamber. The second drop ejector is configured to cause fluid having a second drop weight to be ejected from the firing chamber, wherein the second drop ejector includes a second heating element and second drive circuitry electrically coupled with the second heating element. The present embodiment further comprises a second bore disposed within the orifice layer disposed proximate the second drop ejector, and the second bore is associated with the second drop ejector.

52 Claims, 13 Drawing Sheets

FLUID EJECTION DEVICE

TECHNICAL FIELD

The present claimed invention relates to fluid ejection devices. More specifically, the present claimed invention relates to generating multiple drops weights in a fluid ejection device.

BACKGROUND

As technology progresses, increased performance demands are placed on various components including printing systems. For example, modern printing systems may now handle many different print modes and/or various print media. Furthermore, each print mode and/or print media may use a particular drop weight in order to maximize efficiency of the printing process. That is, when in draft mode, or when operating in high throughput printing conditions, it may be desirable to eject higher weight ink drops from the firing chamber of the printhead. Conversely, photo printing or UIQ (ultimate image quality) printing may be performed more effectively by ejecting lower weight ink drops from the firing chamber of the printhead.

Moreover, UIQ printing is thought to exist only when drop weights are on the order of 1–2 nanograms thereby reaching the visual perception limits of the human eye. Draft mode printing, on the other hand, may typically operate efficiently with ink drop weights of at least 3–6 nanograms. As a result of such different drop weight requirements, a pen having a printhead designed for one type of printing mode or media is often not well suited for use with a separate and different type of printing mode or media.

As yet another concern, the printing mode may not be consistent throughout an entire print job. For example, on a single page it may be desirable to print a high quality image (e.g. a photographic image) on one portion of the page and print a lower quality image (e.g. a monochrome region) on another portion of the page. In such a case, a low drop weight printhead may be used to achieve the photo quality resolution of the photographic image, but such a low drop weight printhead may not be particularly efficient for printing the monochrome region. Thus, a particular printhead which is chosen for its ability to perform photo quality printing, may ultimately reduce the efficiency of an overall printing process.

Thus, a desire has arisen for drop weights that correspond to differing resolutions and that efficiently meet technological demands of sophisticated printing systems.

SUMMARY OF THE INVENTION

In one embodiment, the present invention recites a fluid ejection device comprising a first drop ejector associated with a firing chamber. The first drop ejector is configured to cause fluid having a first drop weight to be ejected from the firing chamber, wherein the first drop ejector includes a first heating element and first drive circuitry electrically coupled with the first heating element. The present embodiment further comprises a first bore disposed within an orifice layer disposed proximate the first drop ejector and associated with the first drop ejector. The present embodiment also comprises a second drop ejector associated with the firing chamber. The second drop ejector is configured to cause fluid having a second drop weight to be ejected from the firing chamber, wherein the second drop ejector includes a second heating element and second drive circuitry electrically coupled with the second heating element. The present embodiment further comprises a second bore disposed within the orifice layer disposed proximate the second drop ejector, and the second bore is associated with the second drop ejector.

BRIEF DESCRIPTION OF THE DRAWINGS

The accompanying drawings, which are incorporated in and form a part of this specification, illustrate embodiments of the invention.

The drawings referred to in this description should be understood as not being drawn to scale except if specifically noted.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, the present invention may be practiced without these specific details.

Figure 1:
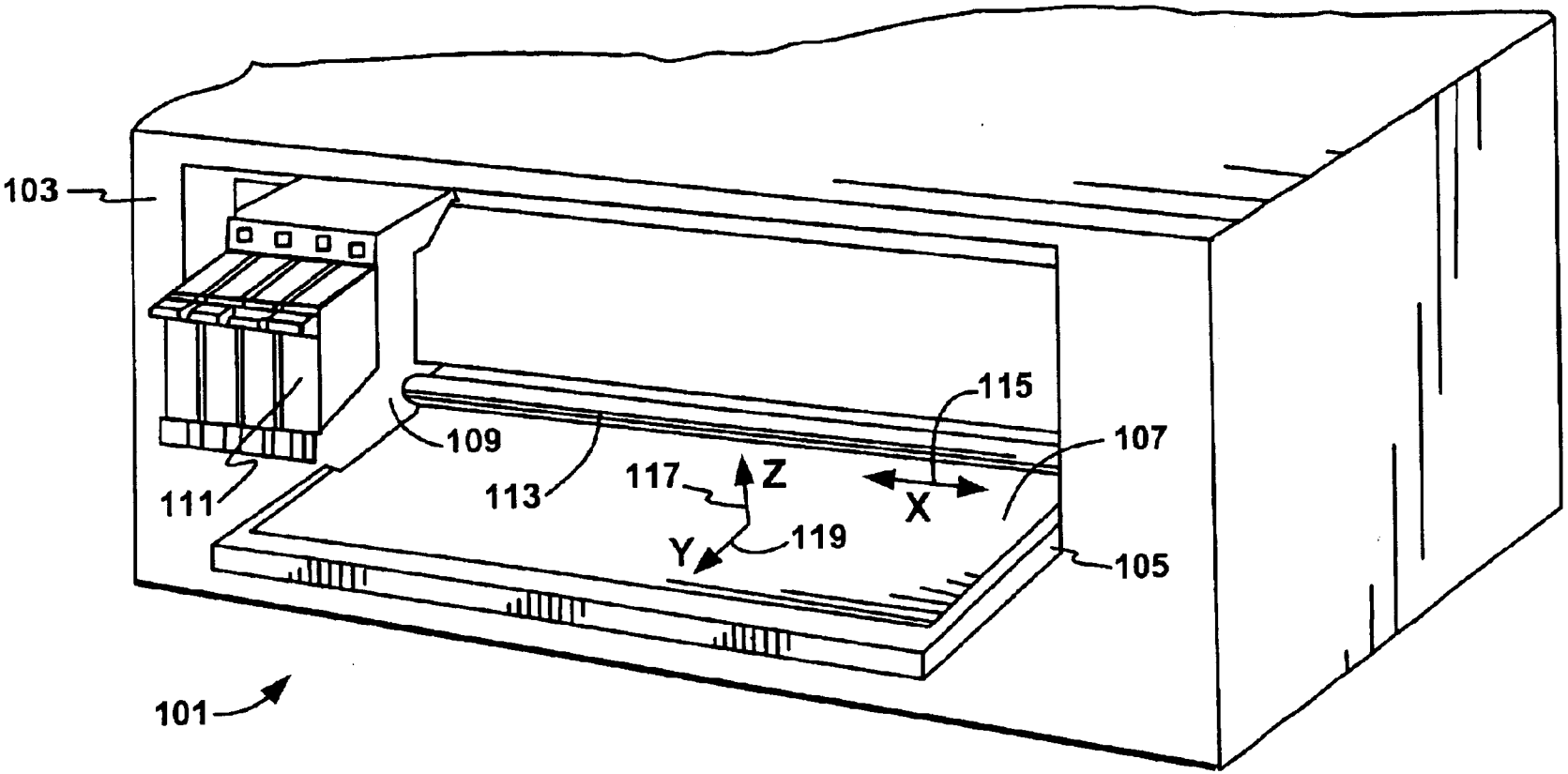
FIG. 1 is a perspective diagram (partial cut-away) of an exemplary printer system in which a printhead including a multi-drop weight firing architecture may be employed in accordance with various embodiments of the present claimed invention.

The following discussion will begin with a general description of the various structures and devices in which embodiments of the present invention may be employed. This general discussion will be provided in conjunction with FIGS. 1–3. The following discussion will then provide, in conjunction with FIGS. 4–10, a detailed description of the multi-drop weight firing architecture, and corresponding method of manufacture, of the present claimed invention. With reference now to FIG. 1, a perspective diagram (partial cut-away) of an exemplary printer system 101 in which a printhead including a multi-drop weight firing architecture may be employed in accordance with embodiments of the present invention is shown. Exemplary printer system 101 includes a printer housing 103 having platen 105 to which input media 107 (e.g. paper) is transported by mechanisms known in the art. Additionally, exemplary printer system 101 includes a carriage 109 holding at least one replaceable printer component 111 (e.g. a printer cartridge) for ejecting fluid such as ink onto input media 107. Carriage 109 is typically mounted on a slide bar 113 or similar mechanism to allow the carriage 109 to be moved along a scan axis, X, denoted by arrow 115. Also, during typical operation, input media 107 is moved along a feed axis, Y, denoted by arrow 119. Often, input media 107 travels along the feed axis, Y, while ink is ejected along an ink drop trajectory axis, Z, as shown by arrow 117. Exemplary printer system 101 is also well suited to use with replaceable printer components such as semi-permanent printhead mechanisms having at least one small volume, on-board, ink chamber that is sporadically replenished from fluidically-coupled, off-axis, ink reservoirs or replaceable printer components having two or more colors of ink available within the replaceable printer components and ink ejecting nozzles specifically designated for each color. Exemplary printer system 101 is also well suited to use with replaceable printer components of various other types and structures. Although such an exemplary printer system 101 is shown in FIG. 1, embodiments of the present invention, as will be described below in detail, are well suited to use with various other types of printer systems.

Figure 2:
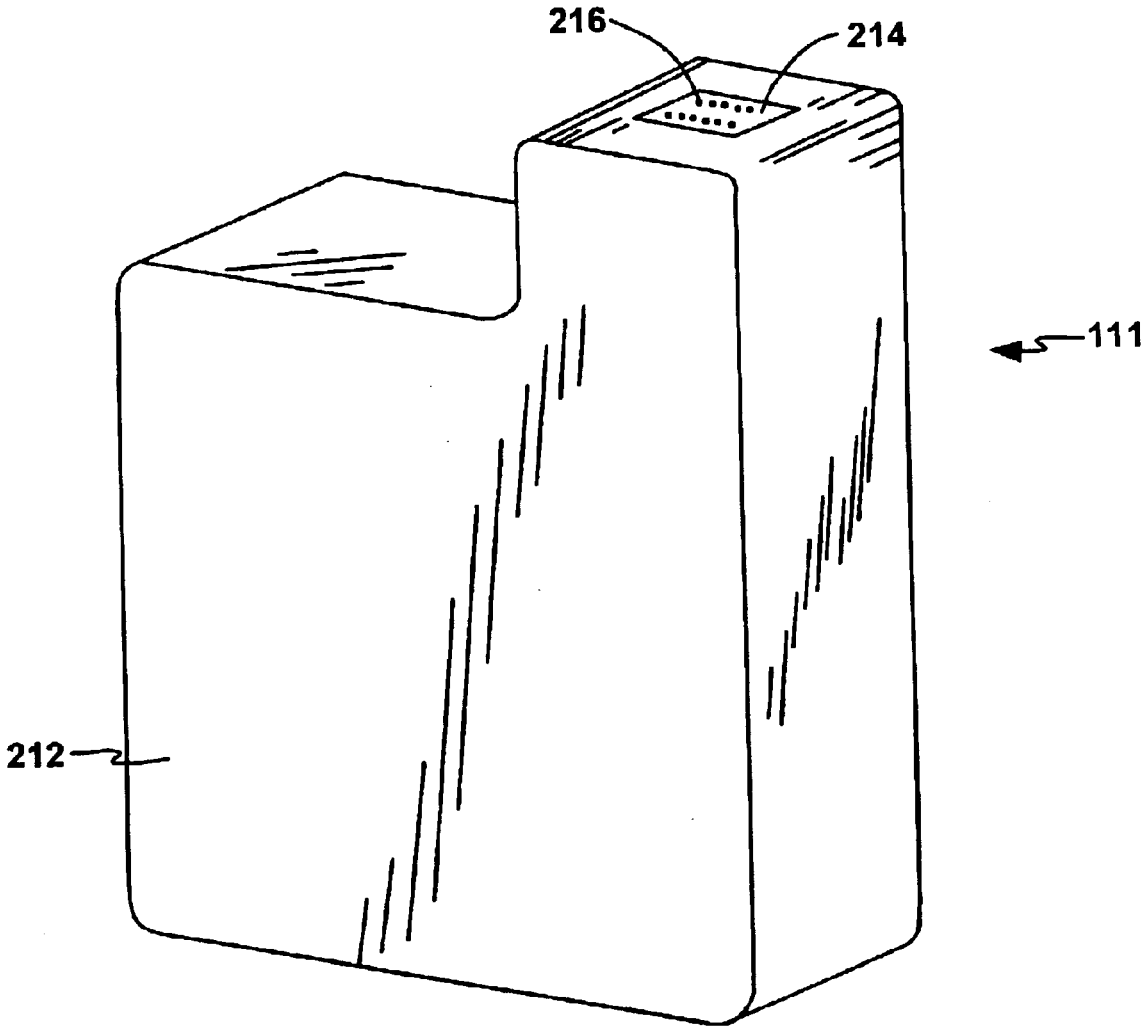
FIG. 2 is a perspective view of a replaceable printer component in which a printhead including a multi-drop weight firing architecture may be employed in accordance with various embodiments of the present claimed invention.

Referring now to FIG. 2, a perspective view is shown of a replaceable printer component 111 in which a printhead including a multi-drop weight firing architecture may be employed in accordance with various embodiments of the present claimed invention. Replaceable printer component 111 is comprised of a housing or shell 212 which contains an internal reservoir of ink (not shown). Replaceable printer component 111 further contains a printhead 214 with orifices (such as bores) 216 corresponding to firing chambers disposed thereunder. During typical operation, ink is ejected from the firing chambers through orifices and is subsequently deposited onto print media 107. Although such a replaceable printer component is shown is FIG. 2, various embodiments of the present invention are well suited to use with numerous other types and/or styles of replaceable printer components.

Figure 3:
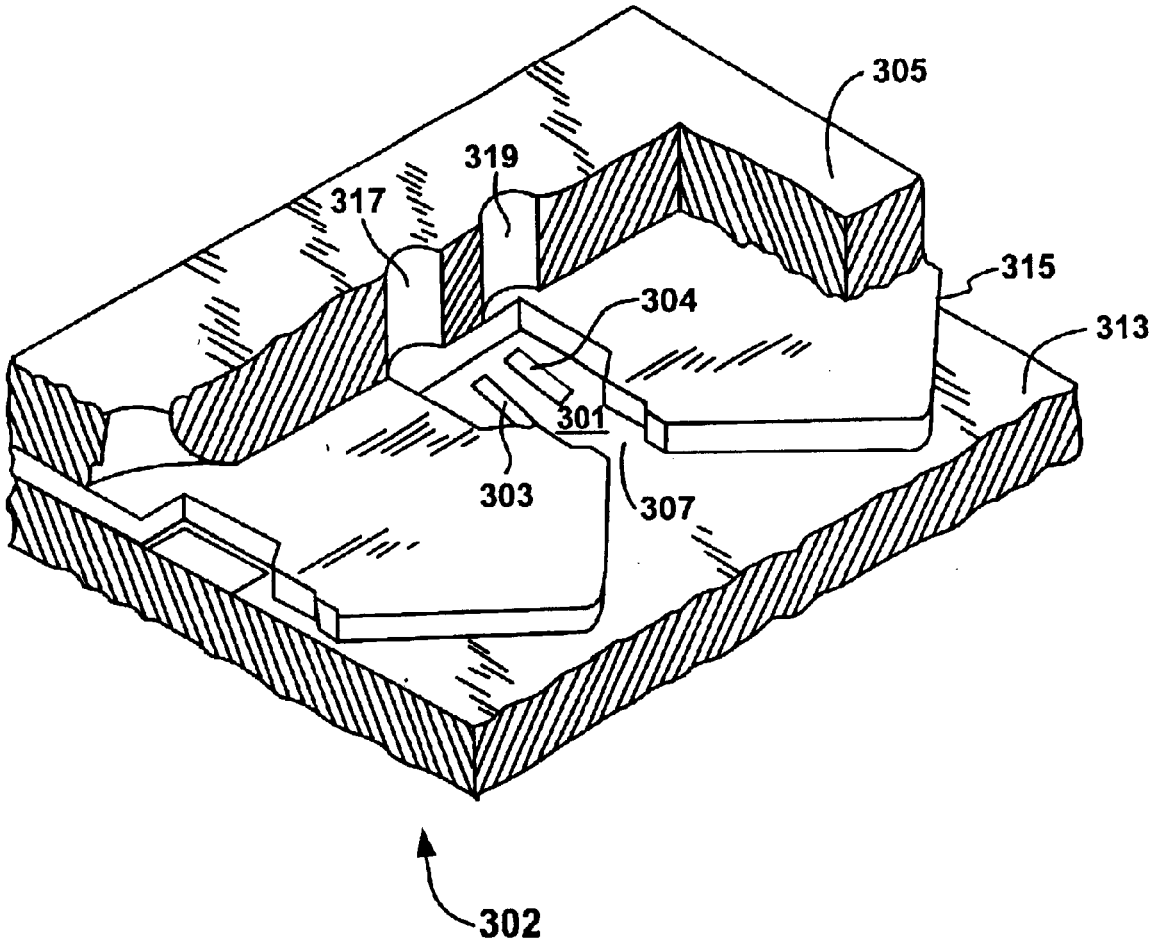
FIG. 3 is a perspective view of a portion of a printhead having a multi-drop weight firing architecture in accordance with various embodiments of the present claimed invention.

With reference now to FIG. 3, a perspective view is shown of a portion 302 of a printhead having a multi-drop weight firing architecture in accordance with various embodiments of the present claimed invention. In accordance with one embodiment of the present invention, portion 302 includes a substrate 313 above which is formed a firing chamber 301. As shown in FIG. 3, in accordance with one embodiment of the present invention, a plurality of heating elements 303 and 304 are schematically shown disposed within firing chamber 301. In the embodiment of FIG. 3, firing chamber 301 is defined partially by firing chamber walls 315. Also, in the present embodiment, each of the plurality of heating elements 303 and 304 is coupled with respective, separately addressable, drive circuitry, not shown. Additionally, portion 302 of the printhead of FIG. 3 includes an opening 307 through which ink is supplied to firing chamber 301. In the present embodiment, an orifice layer 305 is disposed such that openings or bores 317 and 319 formed therethrough are located proximate heating elements 303 and 304, respectively. For purposes of the present application, in one embodiment, the term "drop ejector" refers to a combination of at least one heating element and at least one corresponding drive circuitry. Although such a definition for a drop ejector is used in accordance with one embodiment, the present invention is well suited to use with drop ejector comprised of various components other than a combination of at least one heating element and at least one corresponding drive circuitry. Furthermore, it will be understood that a single or common firing chamber may also have partial walls or other structures disposed between adjacent heating elements. For purposes of the present application, in one embodiment, the terms "common" or "single" firing chamber are defined as given below.

In one embodiment, the bores corresponding to the heating elements are less than approximately 1/600th of an inch apart. In another embodiment, a common firing chamber is defined as a firing chamber fed by a single fluid channel or single group of fluid channels.

Figure 4:
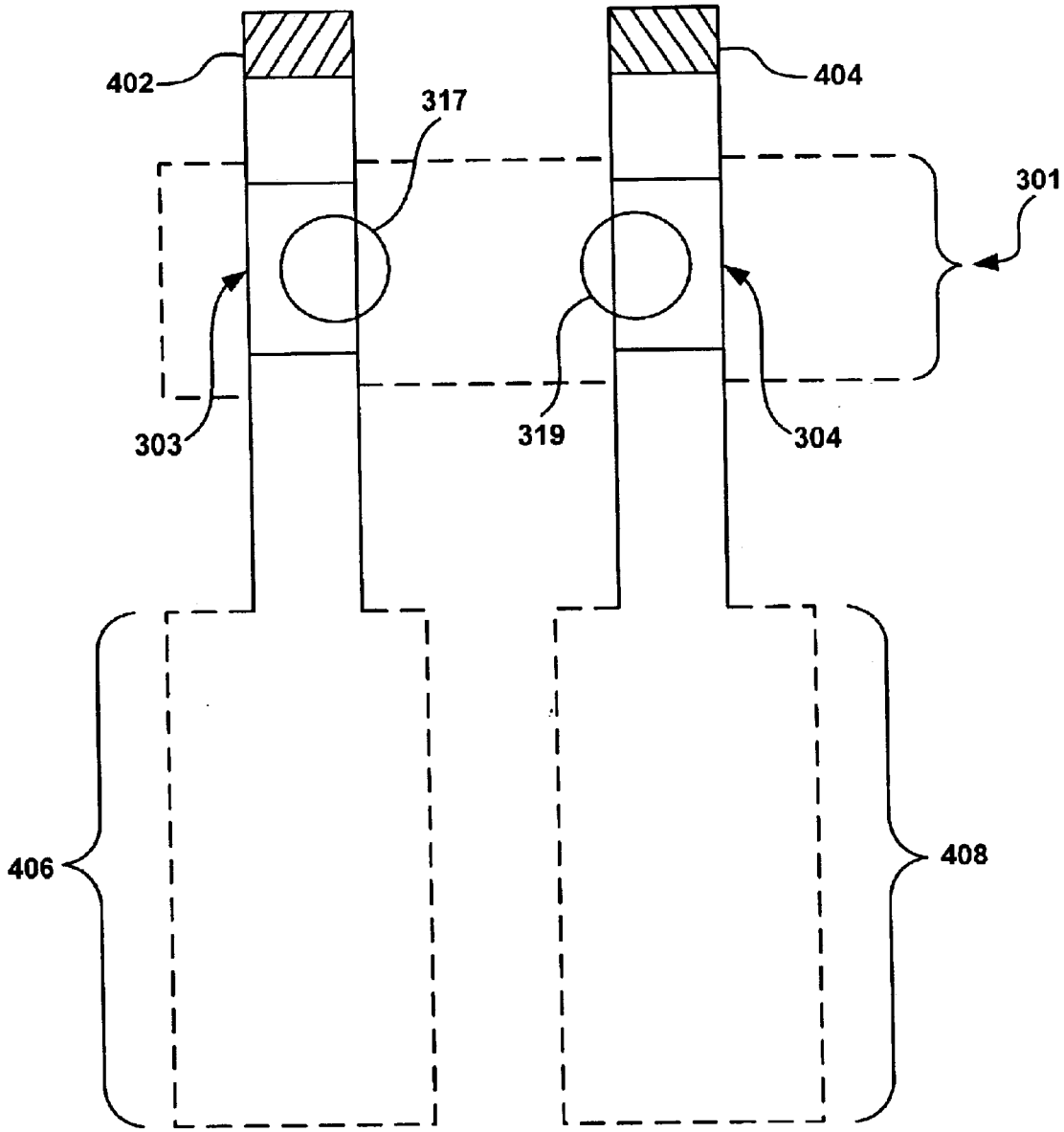
FIG. 4 is a plan view of a plurality of heating elements located in a common firing chamber and a plurality of drive circuitry and bores located proximate to the common firing chamber of a multi-drop weight firing architecture in accordance with various embodiments of the present claimed invention.

With reference now to FIG. 4, a plan view is shown of a plurality of heating elements 303 and 304 located in a common firing chamber 301 and a plurality of drive circuitry 406 and 408 and bores 317 and 319 located proximate to common firing chamber 301 of a multi-drop weight firing architecture in accordance with various embodiments of the present claimed invention. Regions 402 and 404 are provided to illustrate possible electrical contact locations for accommodating current flow through heating elements 303 and 304, respectively. Furthermore, in the present embodiment, heating element 303 is electrically coupled with drive circuitry 406 and is further configured to cause fluid having a first drop weight to be ejected from firing chamber 301. In one embodiment, heating element 303 is designed to have a particular surface area and is also designed to receive sufficient current from drive circuitry 406 to cause fluid having a desired drop weight to be ejected from firing chamber 301. It will be understood that the size of the drop weight generated by heating element 303 can be predetermined by selecting an appropriate heating element surface area and drive circuitry current combination. For example, in one embodiment, a larger drop weight is achieved by increasing the size of heating element 303 such that a larger volume of fluid is ultimately ejected from firing chamber 301. Also, in another embodiment, drive circuitry 406 increases the amount of current applied to heating element 303 such that a larger volume of fluid is ultimately ejected from firing chamber 301. In yet another embodiment, a larger drop weight of fluid is obtained by both increasing the size of heating element 303 and increasing the amount of current applied to heating element 303 by drive circuitry 406.

It will further be understood that the size of the drop weight generated by heating element 303 can also be substantially predetermined by selecting an appropriate bore size and/or shape. Specifically, in one embodiment, a larger bore size is used such that a larger volume of fluid is ultimately ejected from firing chamber 301. In another embodiment, the size of the bore or bores is reduced such that a smaller volume of fluid is ultimately ejected from firing chamber 301. It will further be understood that, in various embodiments of the present invention, the shape of the bores is adjusted to achieve a larger or smaller drop weight.

More specifically, in one embodiment a 5 nanogram drop weight is achieved by using heating element with a surface area of approximately 400 square micrometers, and by selecting a bore diameter of approximately 13 micrometers (bore area of approximately 133.5 square micrometers). As another example, for a lower drop weight (e.g. 1–2 nanograms), one embodiment utilizes a heating element with a surface area of approximately 250 square micrometers, and selects a bore diameter of approximately 8 micrometers (bore area of approximately 50.5 square micrometers).

Also, heating element 304 is electrically coupled with drive circuitry 408 and is further configured to cause fluid having a second drop weight to be ejected from firing chamber 301. In one embodiment, heating element 304 is designed to have a particular surface area and is also designed to receive sufficient current from drive circuitry 408 to cause fluid having a desired drop weight to be ejected from firing chamber 301.

It will be understood that the size of the drop weight generated by heating element 304 can also be predetermined by selecting an appropriate heating element surface area and drive circuitry current combination. For example, in one embodiment, a larger drop weight is achieved by increasing the size of heating element 304 such that a larger volume of fluid is ultimately ejected from firing chamber 301. Also, in another embodiment, drive circuitry 408 increases the amount of current applied to heating element 304 such that a larger volume of fluid is ultimately ejected from firing chamber 301. In yet another embodiment, a larger drop weight of fluid is obtained by both increasing the size of heating element 304 and increasing the amount of current applied to heating element 304 by drive circuitry 408.

It will further be understood that the size of the drop weight generated by heating element 304 can also be predetermined by selecting an appropriate bore size and/or shape. Specifically, in one embodiment, a larger bore size is used such that a larger volume of fluid is ultimately ejected from firing chamber 301. In another embodiment, the size of the bore or bores is reduced such that a smaller volume of fluid is ultimately ejected from firing chamber 301. It will further be understood that, in various embodiments of the present invention, the shape of the bores is adjusted to achieve a larger or smaller drop weight.

As an example, in one embodiment a 5 nanogram drop weight is achieved by using heating element with a surface area of approximately 400 square micrometers, and by selecting a bore diameter of approximately 13 micrometers (bore area of approximately 133.5 square micrometers). As another example, for a lower drop weight (e.g. 1–2 nanograms), one embodiment utilizes a heating element with a surface area of approximately 250 square micrometers, and selects a bore diameter of approximately 8 micrometers (bore area of approximately 50.5 square micrometers).

Referring still to FIG. 4, in the present embodiment, drive circuitry 406 and drive circuitry 408 are separately addressable. That is, each of drive circuitry 406 and drive circuitry 408 can be independently activated and controlled such that fluid having the first drop weight is ejectable from firing chamber 301 in one embodiment substantially concurrently or in a second embodiment separately from fluid having the second drop weight. In the present embodiment, each of drive circuitry 406 and drive circuitry 408 are comprised, for example, of a transistor coupled with addressing interconnections and the like for selectively providing current to heating elements 303 and 304, respectively. Although such a drive circuitry structure is recited in the present embodiment, the present invention is not limited to such an embodiment, and, in fact, the present invention is well suited to use with various other types of drive circuitry for providing current to a respective heating element.

By providing a plurality of heating elements, for example, heating elements 303 and 304, in a common firing chamber, 301, wherein separate heating elements 303 and 304 are coupled to separately addressable drive circuitry 406 and 408, respectively, the present embodiment realizes significant benefits. As an example, in one embodiment, heating element 303 is configured to cause fluid having a drop weight on the order of 1–2 nanograms to be ejected from firing chamber 301. For example, in one embodiment, the desired drop weight is achieved by altering the size of heating element 303 such that the desired volume of fluid is ultimately ejected from firing chamber 301. As mentioned above, a 1–2 nanogram drop weight is used to achieve UIQ (ultimate image quality) resolution. Thus, when drive circuitry 406 is activated, heating element 303 will cause fluid having a drop weight meeting UIQ printing specifications to be ejected from firing chamber 301. Furthermore, in the present embodiment, heating element 304 is configured to cause fluid having a drop weight on the order of 3 nanograms to be ejected from firing chamber 301. For example, in one embodiment, the desired drop weight is achieved by selecting the size of heating element 304 such that the desired volume of fluid is ultimately ejected from firing chamber 301. As mentioned above, draft mode printing, for example, may typically operate efficiently with ink drop weights of at least 3–6 nanograms. Thus, when only drive circuitry 408 is activated, heating element 304 will cause fluid having a drop weight commensurate with drafting mode printing specifications to be ejected from firing chamber 301.

Referring still to FIG. 4, because drive circuitry 406 and 408 are separately addressable, heating elements 303 and 304 can be activated in one embodiment substantially concurrently or in a second embodiment separately. As a result, the present embodiment can further enhance the efficiency of printing, for example, in draft mode by substantially concurrently activating drive circuitry 406 and 408. In so doing, heating element 303 will cause fluid having a drop weight on the order of 1–2 nanograms to be ejected from firing chamber 301 concurrent with heating element 304 causing fluid having a drop weight on the order of 3 nanograms to be ejected from firing chamber 301. Thus, a total drop weight of 4–5 nanograms will by produced by the present embodiment. This increased total drop weight enables greater media throughput speeds while maintaining print quality. Hence, the multi-drop weight firing architecture of the present embodiment is able to selectively generate, from a single firing chamber 301, a drop weight of 1–2 nanograms, a drop weight of 3 nanograms, or a drop weight of 4–5 nanograms. In one embodiment, the plurality of drops of fluid ejected from firing chamber 301 merge prior to impacting the print media. In another embodiment, the plurality of drops of fluid ejected from firing chamber merge after reaching the print media.

It should be noted that the present invention is not limited to the specific drop weight examples given above. That is, the present invention is well suited to generating various other drop sizes for one or both of heating elements 303 and 304. For example, both heating element 303 and heating element 304 can be configured to cause fluid having a drop weight on the order of 1–2 nanograms to be ejected from firing chamber 301. In such an embodiment, the plurality of independently activatable heating elements, 303 and 304, disposed in the common firing chamber can be used, for example, to provide redundancy or can be fired alternately to provide for increased fluid flux.

Furthermore, the present embodiment specifically recites an embodiment in which two heating elements, disposed in a common firing chamber, each have a respective drive circuitry electrically coupled therewith. The present invention is, however, also well suited to an embodiment in which there are "x" heating elements (e.g. 6 heating elements), disposed in a common firing chamber, are electrically coupled with less than "fx" respective sets of drive circuitry. That is, the present invention is well suited to an embodiment in which a plurality of heating elements (greater than two) are disposed in a common firing chamber, and a plurality of sets (not necessarily greater than two) of independently addressable drive circuitry are used to control the plurality of heating elements.

As yet another advantage, the multi-drop weight firing architecture of the present invention is also well suited to dynamically selecting the cumulative drop weight ejected from firing chamber 301. Such an embodiment is particularly beneficial, for example, when the printing mode is not consistent throughout an entire print job. For purpose of illustration of the present embodiment, assume it is desirable to print a high quality image (e.g. a photographic image) on one portion of a page and print a lower quality image (e.g. a monochrome region) on another portion of the page. In such a case, the present embodiment will activate beating element 304 using drive circuitry 408 and thereby cause fluid having a drop weight on the order of 3 nanograms to be ejected from firing chamber 301. Hence, the present embodiment will generate the higher drop weight to efficiently print the monochrome region. Moreover, when it is useful to print the photographic image on the page, the present embodiment will dynamically cease firing of heating element 304, using drive circuitry 408, and instead activate only heating element 303, via drive circuitry 406, thereby causing fluid having a drop weight on the order of 1–2 nanograms to be ejected from firing chamber 301. Hence, the present embodiment will dynamically generate the low drop weight to achieve the resolution to properly print the photographic image. When it is no longer useful to generate the low drop weight, the present embodiment can dynamically re-activate heating element 304 using drive circuitry 408 to increase printing efficiency and throughput. Also, while printing the lower quality image, the present invention is also well suited to dynamically activating both heating element 303 and heating element 304 to produce a cumulative drop weight of 4–5 nanograms to even further increase printing efficiency throughout. Once again, it should be noted that the present invention is not limited to the specific drop weight examples given above. That is, the present invention is well suited to generating various other drop sizes for one or both of heating elements 303 and 304.

Thus, the present embodiment of the multi-drop weight firing architecture is able to accommodate multiple printing modes or media with, for example, a single printhead. Furthermore, the multi-drop weight firing architecture of the present embodiment is able to accommodate multiple printing modes or types using a single printhead and without ultimately reducing the efficiency of an overall printing process.

Furthermore, although the present embodiment of the multi-drop weight firing architecture has significant advantages associated therewith, the multi-drop weight firing architecture is compatible with existing firing chamber, printhead, and printer component fabrication processes. That is, the present multi-drop weight firing architecture can be manufactured using existing fabrication processes and equipment.

With reference again to FIG. 4, in one embodiment of the present invention, bores 317 and 319 are formed proximate to and correspond with heating element 303 and heating element 304, respectively. In the present embodiment, bore 317 is disposed to direct the flow or trajectory of fluid which heating element 303 causes to be ejected from firing chamber 301. Similarly, bore 319 is disposed to direct the flow or trajectory of fluid which heating element 304 causes to be ejected from firing chamber 301. In the embodiment of FIG. 4, bores 317 and 319 are disposed offset from heating element 303 and heating element 304, respectively. That is, the center of bore 317 is not centered with respect to heating element 303, and, similarly, the center of bore 319 is not centered with respect to heating element 304. The orientation and function of bores 317 and 319 are further described in conjunction with FIGS. 5A and 5B below.

Figure 5A:
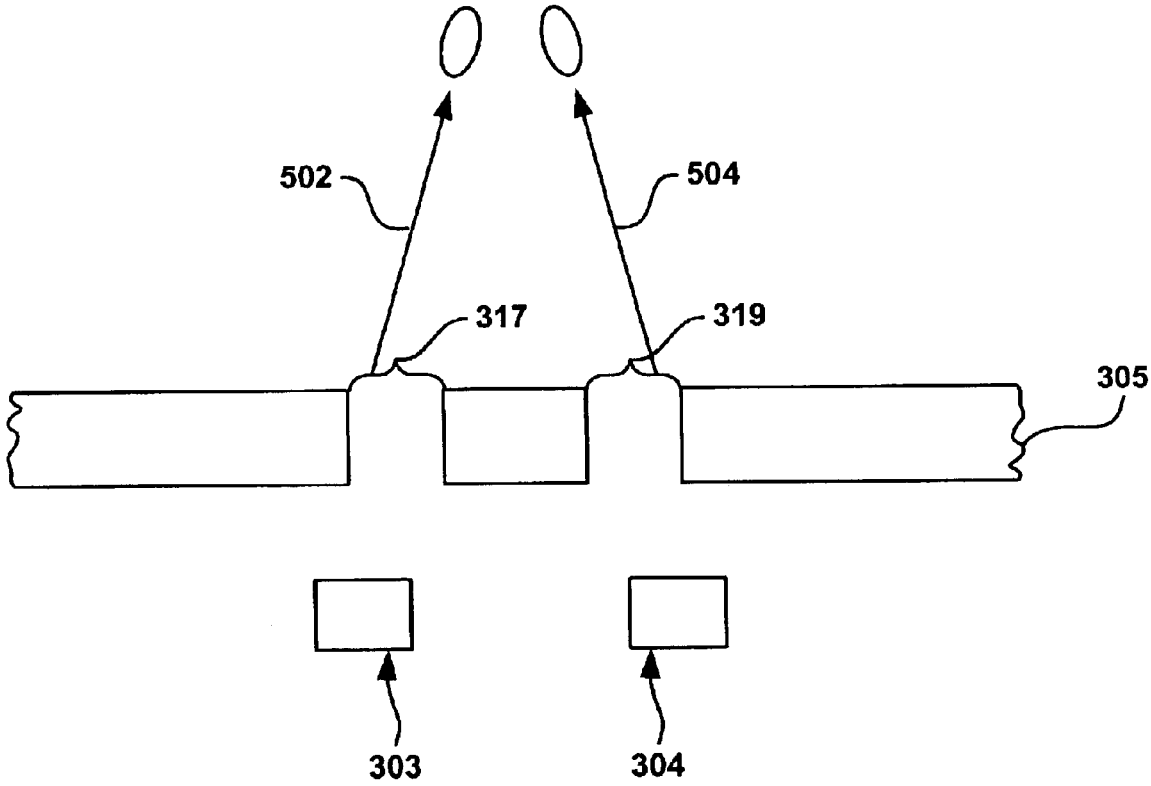
FIG. 5A is a side sectional schematic view of a plurality of heating elements located in a common firing chamber and corresponding offset bores located proximate to the common firing chamber of a multi-drop weight firing architecture in accordance with various embodiments of the present claimed invention.

Referring now to FIG. 5A, a side sectional schematic view is shown of a plurality of heating elements 303 and 304 located in a common firing chamber, and corresponding offset bores 317 and 319, respectively, formed through, for example, an orifice layer 305. As shown in FIG. 5A, in one embodiment of the present invention, bores 317 and 319 are disposed offset from (i.e. not centered with respect to) heating element 303 and heating element 304, respectively. In so doing, fluid which heating element 303 causes to be ejected from the common firing chamber is directed along an angled trajectory as schematically indicated by arrow 502. Likewise, in the embodiment of FIG. 5A, fluid which heating element 304 causes to be ejected from the common firing chamber is directed along an angled trajectory as schematically indicated by arrow 504. In so doing, the present embodiment is able to direct or "aim" the ejected fluid in a desired direction. In one embodiment, the ejected fluid is directed towards a common location such as, for example, a desired pixel location on a print medium. Although both of bores 317 and 319 are disposed in an offset orientation in the present embodiment, the present invention is also well suited to an embodiment in which only one or the other of bores 317 and 319 are centered over their corresponding heating element. Furthermore, the present invention is also well suited to an embodiment in which the trajectory of the ejected fluid is other than that shown in the embodiment of FIG. 5A. Although offset bores are used in the present embodiment to achieve an angled trajectory for the ejected fluid, the present invention is also well suited to using various approaches other than offset bores to achieve an angled trajectory for the ejected fluid.

Figure 5B:
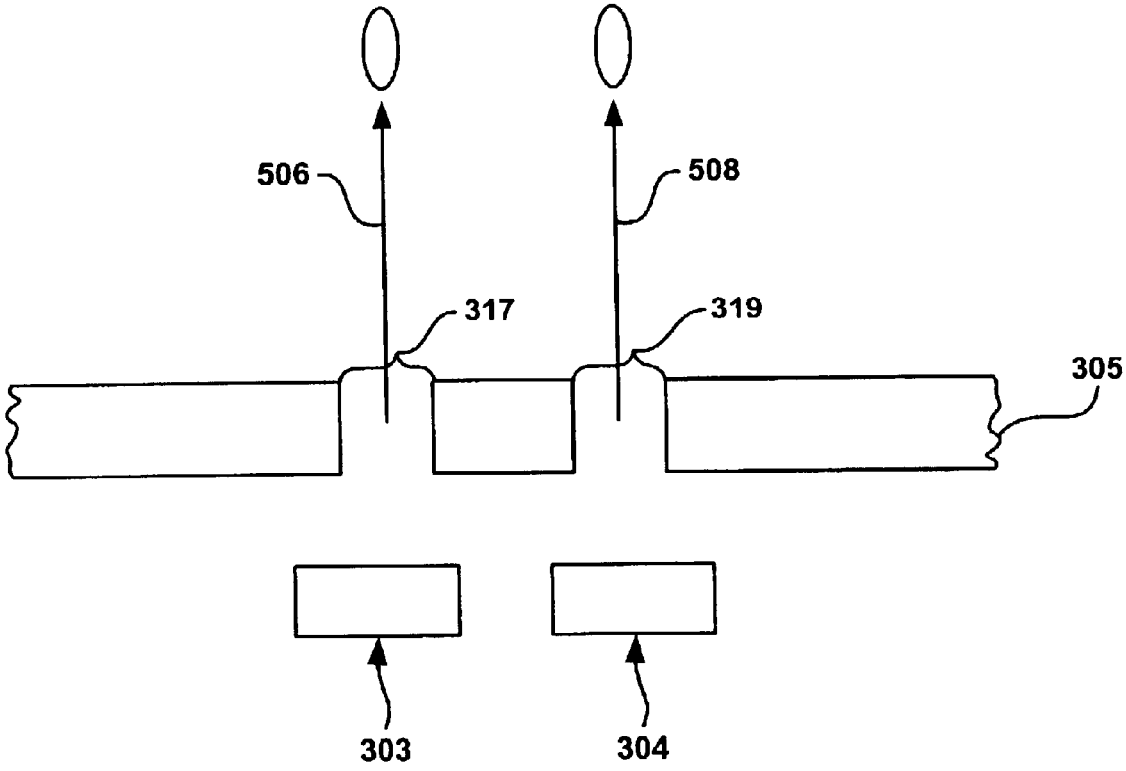
FIG. 5B is a side sectional schematic view of a plurality of heating elements located in a common firing chamber and corresponding bores located proximate to the common firing chamber of a multi-drop weight firing architecture in accordance with various embodiments of the present claimed invention.

With reference now to FIG. 5B, a side sectional schematic view is shown of a plurality of heating elements 303 and 304 located in a common firing chamber, and corresponding aligned bores 317 and 319, respectively, formed through, for example, an orifice layer 305. As shown in FIG. 5B, in one embodiment of the present invention, bores 317 and 319 are disposed aligned with (i.e. centered with respect to) heating element 303 and heating element 304, respectively. In so doing, fluid which heating element 303 causes to be ejected from the common firing chamber is directed along a trajectory as indicated by arrow 506. Likewise, in the embodiment of FIG. 5B, fluid which heating element 304 causes to be ejected from the common firing chamber is directed along a trajectory as indicated by arrow 508 which is substantially parallel to the trajectory indicated by arrow 506. Although both of bores 317 and 319 are disposed in a centered orientation in the present embodiment, the present invention is also well suited to an embodiment in which only one or the other of bores 317 and 319 are centered with their corresponding heating element.

Figure 6:
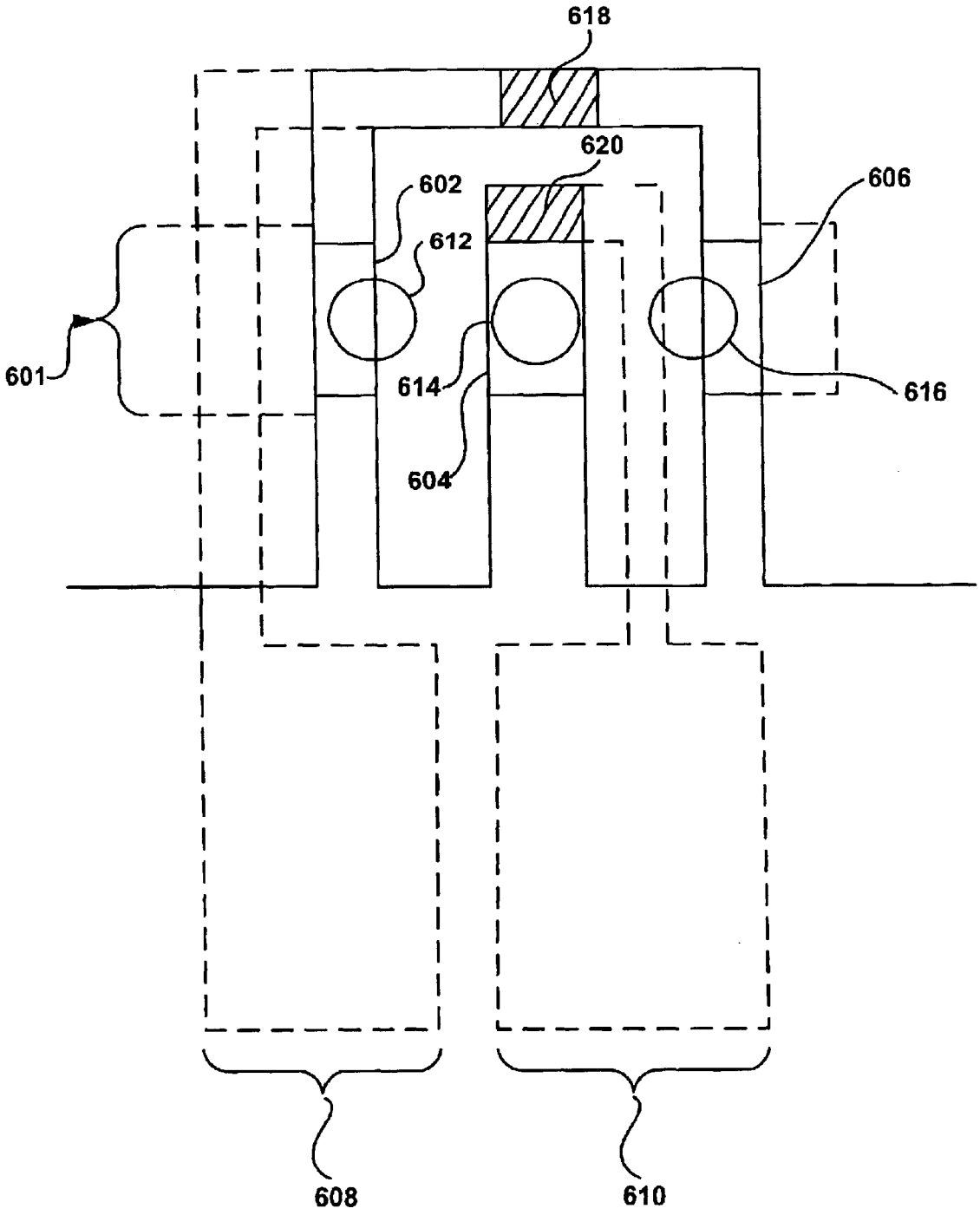
FIG. 6 is a plan view of another configuration of a plurality of heating elements located in a common firing chamber and a plurality of drive circuitry and bores located proximate to the common firing chamber of a multi-drop weight firing architecture in accordance with various embodiments of the present claimed invention.

With reference now to FIG. 6, a plan view is shown, in accordance with one embodiment of the present claimed invention, of a plurality of heating elements 602, 604, and 606 located in a common firing chamber schematically denoted as 601. The present embodiment also includes a plurality of drive circuitry 608 and 610 and bores 612, 614, and 616 located proximate to common firing chamber 601. Region 618 is provided to illustrate a possible electrical contact location for accommodating current flow through heating elements 602 and 606. Region 620 is provided to illustrate a possible electrical contact location for accommodating current flow through heating element 604. In the present embodiment, heating element 604 is electrically coupled with drive circuitry 610 and is further configured to cause fluid having a first drop weight to be ejected from firing chamber 601.

In one embodiment, heating element 604 is designed to have a particular surface area and is also designed to receive sufficient current from drive circuitry 610 to cause fluid having a desired drop weight to be ejected from firing chamber 601. It will be understood that the size of the drop weight generated by heating element 604 can be predetermined by selecting an appropriate heating element surface area and drive circuitry current combination. Additionally or alternatively, it will further be understood that the size of the drop weight generated by heating element 604 can also be predetermined by selecting an appropriate bore size and/or shape. Specifically, in one embodiment, a larger bore size is used such that a larger volume of fluid is ultimately ejected from firing chamber 601. In another embodiment, the size of the bore or bores is reduced such that a smaller volume of fluid is ultimately ejected from firing chamber 601. It will further be understood that, in various embodiments of the present invention, the shape of the bores is adjusted to achieve a larger or smaller drop weight.

Furthermore, in the present embodiment, drive circuitry 608 is electrically coupled with heating elements 602 and 606 which are configured to cause fluid having a second drop weight and a third drop weight, respectively, to be ejected from firing chamber 601. In one embodiment, heating elements 602 and 606.are designed to have particular, respective, surface areas and are also designed to receive sufficient current from drive circuitry 608 to cause fluid having the desired second and third drop weights to be ejected from firing chamber 601. It will be understood that the size of the second and third drop weights generated by heating elements 602 and 606, respectively, can be predetermined by selecting an appropriate heating element surface area and drive circuitry current combination. Additionally or alternatively, it will further be understood that the size of the drop weight generated by heating elements 602 and 606 can also be predetermined by selecting an appropriate bore size and/or shape. It will further be understood that the size of the drop weight generated by heating elements 602 and 606 can also be predetermined by selecting an appropriate bore size and/or shape. Specifically, in one embodiment, a larger bore size is used such that a larger volume of fluid is ultimately ejected from firing chamber 601. In another embodiment, the size of the bore or bores is reduced such that a smaller volume of fluid is ultimately ejected from firing chamber 601. It will further be understood that, in various embodiments of the present invention, the shape of the bores is adjusted to achieve a larger or smaller drop weight.

More specifically, in one embodiment a 5 nanogram drop weight is achieved by using heating element with a surface area of approximately 400 square micrometers, and by selecting a bore diameter of approximately 13 micrometers (bore area of approximately 133.5 square micrometers). As another example, for a lower drop weight (e.g. 1–2 nanograms), one embodiment utilizes a heating element with a surface area of approximately 250 square micrometers, and selects a bore diameter of approximately 8 micrometers (bore area of approximately 50.5 square micrometers).

Although such a structural configuration is shown in the embodiment of FIG. 6, the present invention is well suited to various other configurations for the present multi-drop weight firing architecture. For example, the present invention is also well suited to an embodiment which includes more than three heating elements within a common firing chamber. The present embodiment is also well suited to an embodiment in which a single heating element is configured to substantially concurrently cause the generation of more than two drops of fluid to be ejected from a firing chamber. In such an embodiment, the single heating element will include more than two regions which cause the ejection of fluid once drive circuitry applies current thereto. The present invention is also well suited to an embodiment in which each of heating elements 602, 604, and 606 is coupled to separate independently addressable drive circuitry (i.e. where heating elements 602 and 606 do not share a common drive circuitry). More generally, the embodiment of the present multi-firing architecture is comprised of at least two heating elements coupled to a respective at least two drive circuits.

With reference again to FIG. 6, the present embodiment provides a multi-drop weight firing architecture which can selectively eject up to three separate drops from common firing chamber 601. That is, the present embodiment can eject only fluid having a first drop weight as is generated by heating element 604. Alternatively, the present embodiment can eject fluid having a second drop weight and a third drop weight as is generated by heating element 602 and 606, respectively. The heating elements 602 and 606 eject the second and third drops weights substantially concurrently.

Lastly, the present embodiment can substantially concurrently eject fluid having the first drop weight, fluid having the second drop weight, and fluid having the third drop weight. More specifically, in the present embodiment, drive circuitry 608 and drive circuitry 610 are separately addressable. That is, each of drive circuitry 608 and drive circuitry 610 can be independently activated and controlled such that fluid having the first drop weight is ejectable from firing chamber 601 substantially concurrently in one embodiment or separately in another embodiment from fluid having the second drop weight and fluid having the third drop weight. In the present embodiment, each of drive circuitry 608 and drive circuitry 610 are comprised, for example, of a transistor coupled with addressing interconnections and the like for selectively providing current to heating elements 602 and 606, and heating element 604, respectively. Although such a drive circuitry structure is recited in the present embodiment, the present invention is not limited to such an embodiment, and, in fact, the present invention is well suited to use with various other types of drive circuitry for providing current to a respective heating element.

Referring still to FIG. 6, in one embodiment, heating element 602 is configured to cause fluid having a drop weight on the order of 2 nanograms to be ejected from firing chamber 601. For example, in one embodiment, a desired drop weight is achieved by selecting the size of heating element 602 such that a desired volume of fluid is ultimately ejected from firing chamber 601. Also, in another embodiment, drive circuitry 608 varies the amount of current applied to heating element 602 such that a desired volume of fluid is ultimately ejected from firing chamber 601. In yet another embodiment, a larger drop weight of fluid is obtained by both increasing the size of heating element 602 and increasing the amount of current applied to heating element 602 by drive circuitry 608.

A 1–2 nanogram drop weight achieves UIQ (ultimate image quality) resolution in one embodiment. Thus, when only drive circuitry 610 is activated, heating element 604 will cause fluid having a drop weight meeting UIQ printing specifications to be ejected from firing chamber 601. Furthermore, in the present embodiment, heating element 602 and heating element 606 are each configured to cause fluid having a drop weight on the order of 4 nanograms to be ejected from firing chamber 601. As mentioned above, draft mode printing, for example, may typically operate efficiently with ink drop weights of at least 3–6 nanograms. Thus, when only drive circuitry 608 is activated, heating elements 602 and 606 will cause fluid having a combined drop weight of 8 nanograms (i.e. a drop weight commensurate with drafting mode printing requirements) to be ejected from firing chamber 601.

Referring still to FIG. 6, because drive circuitry 608 and 610 are separately addressable, heating element 604, and heating elements 602 and 606 can be activated substantially concurrently or separately. As a result, the present embodiment can further enhance the efficiency of printing, for example, in draft mode by substantially concurrently activating drive circuitry 608 and 610. In so doing, heating element 604 will cause fluid having a drop weight on the order of 2 nanograms to be ejected from firing chamber 601 substantially concurrent with each of heating elements 602 and 606 causing fluid having a drop weight on the order of 4 nanograms to be ejected from firing chamber 601. Thus, a total drop weight of 10 nanograms will by produced by the present embodiment. This increased total drop weight enables greater media throughput speeds while maintaining print quality. Hence, the multi-drop weight firing architecture of the present embodiment is able to selectively generate, from a single firing chamber 601, a drop weight of 2 nanograms, a drop weight of 8 nanograms, or a drop weight of 10 nanograms. In one embodiment, the plurality of drops of fluid ejected from firing chamber 601 merge prior to impacting the print media. In another embodiment, the plurality of drops of fluid ejected from firing chamber merge after reaching the print media.

It should be noted that the present invention is not limited to the specific drop weight examples given above. That is, the present invention is well suited to generating various other drop sizes for one or both of heating elements 602 and 606. Likewise, the present invention is well suited to generating various other drop sizes for heating element 604. For example, both heating element 602 and heating element 606 can be configured to cause fluid having a drop weight on the order of 2 nanograms to be ejected from firing chamber 601. In such an embodiment, the plurality of independently activatable heating elements, 602, 604, and 606, disposed in the common firing chamber can be used, for example, to provide redundancy or can be fired serially to provide for increased fluid flux.

As yet another advantage, one embodiment of the multi-drop weight firing architecture of the present invention is also well suited to dynamically selecting the cumulative drop weight ejected from firing chamber 601. Such an embodiment is particularly beneficial, for example, when the printing mode is not consistent throughout an entire print job. For purpose of illustration of the present embodiment, assume it is desirable to print a high quality image (e.g. a photographic image) on one portion of a page and print a lower quality image (e.g. a monochrome region) on another portion of the page. In such a case, the present embodiment will activate heating elements 602 and 606 using drive circuitry 608 and thereby cause fluid having a cumulative drop weight on the order of 8 nanograms to be ejected from firing chamber 601. Hence, the present embodiment will generate the higher drop weight to more efficiently print the monochrome region. Moreover, when printing the photographic image on the page, the present embodiment will dynamically cease firing of heating elements 602 and 606, using drive circuitry 608, and instead activate only heating element 604, via drive circuitry 610, thereby causing fluid having a drop weight on the order of 2 nanograms to be ejected from firing chamber 601. Hence, the present embodiment will dynamically generate the low drop weight to achieve the resolution that properly prints the photographic image. When it is no longer useful to generate the low drop weight, the present embodiment can dynamically re-activate heating elements 602 and 606 using drive circuitry 608 to increase printing efficiency and throughput. Also, while printing the lower quality image, the present invention is also well suited to dynamically activating both heating elements 602 and 606, and heating element 604 to produce a cumulative drop weight of 10 nanograms to even further increase printing efficiency throughout. Once again, it should be noted that the present invention is not limited to the specific drop weight examples given above. That is, the present invention is well suited to generating various other drop sizes for one or both of heating elements 602 and 606 and also to generating various other drop sizes for heating element 604.

Thus, an embodiment of the present multi-drop weight firing architecture is able to accommodate multiple printing modes or media with, for example, a single printhead. Furthermore, the multi-drop weight firing architecture of the present embodiment is able to accommodate multiple printing modes or types using a single printhead and without ultimately reducing the efficiency of an overall printing process.

Furthermore, although the present multi-drop weight firing architecture has significant advantages associated therewith, the multi-drop weight firing architecture of the present embodiment is compatible with existing firing chamber, printhead, and printer component fabrication processes. That is, the present multi-drop weight firing architecture can be manufactured using existing fabrication processes and equipment.

With reference again to FIG. 6, in one embodiment of the present invention, bores 612 and 616 are formed proximate to and correspond with heating element 602 and heating element 606, respectively. Similarly, a bore 614 is formed proximate to and corresponds with heating element 604. In the present embodiment, bore 612 is disposed to direct the flow or trajectory of fluid which heating element 602 causes to be ejected from firing chamber 601. Similarly, bore 616 is disposed to direct the flow or trajectory of fluid which heating element 606 causes to be ejected from firing chamber 601. Also, bore 614 is disposed to direct the flow or trajectory of fluid which heating element 604 causes to be ejected from firing chamber 601. In the embodiment of FIG. 6, bores 612 and 616 are disposed offset from heating element 602 and heating element 606, respectively. That is, the center of bore 612 is not centered with respect to heating element 602, and, similarly, the center of bore 616 is not centered with respect to heating element 606. The orientation and function of bores 612, 614, and 616 are further described in conjunction with FIGS. 7A and 7B below.

Figure 7A:
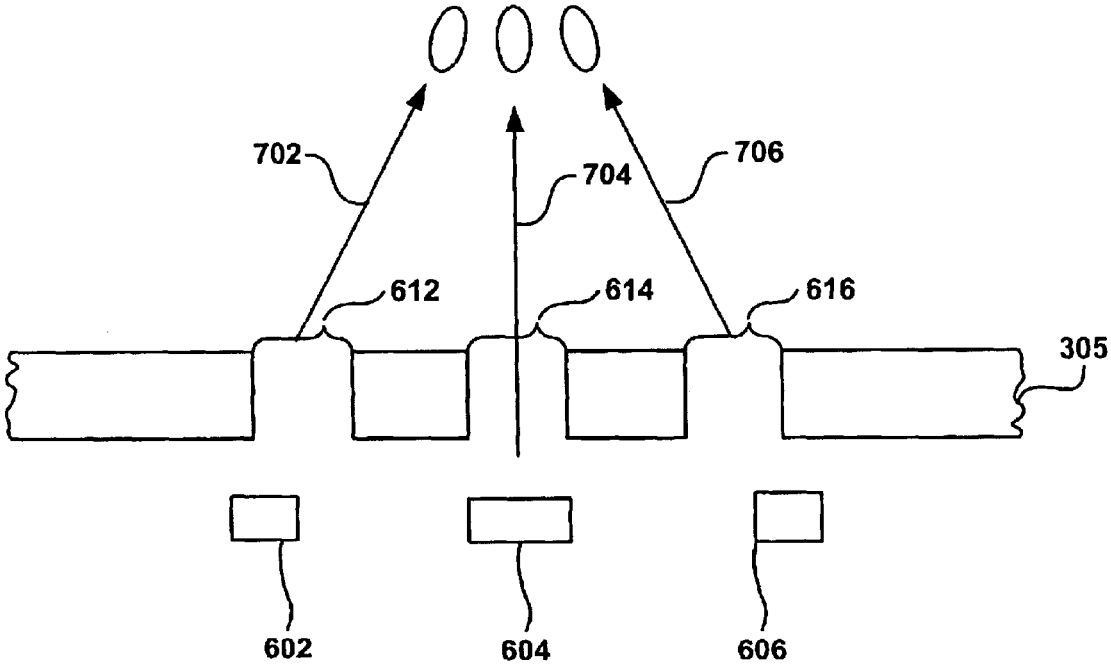
FIG. 7A is a side sectional schematic view of a plurality of heating elements located in a common firing chamber and corresponding bores (some of which are offset) located proximate to the common firing chamber of a multi-drop weight firing architecture in accordance with various embodiments of the present claimed invention.

Referring now to FIG. 7A, a side sectional schematic view is shown of a plurality of heating elements 602, 604, and 606 located in a common firing chamber, and corresponding bores 612, 614, and 616, respectively, formed through, for example, an orifice layer 305. As shown in FIG. 7A, in one embodiment of the present invention, bores 612 and 616 are disposed offset from (i.e. not centered with respect to) heating element 602 and heating element 606, respectively. In so doing, fluid which heating element 602 causes to be ejected from the common firing chamber is directed along an angled trajectory as schematically indicated by arrow 702. Likewise, in the embodiment of FIG. 7A, fluid which heating element 606 causes to be ejected from the common firing chamber is directed along an angled trajectory as schematically indicated by arrow 706. In so doing, the present embodiment is able to direct or "aim" the ejected fluid in a desired direction. In one embodiment, the ejected fluid from bores 602, 614, and 616 is directed towards a common location such as, for example, a desired pixel location on a print medium. In the embodiment of FIG. 7A, bore 614 is not offset from heating element 604 such that fluid ejected the common firing chamber is directed along the trajectory indicated by arrow 704. Although bores 612 and 616 are disposed in an offset orientation in the present embodiment, the present invention is also well suited to an embodiment in which only one or the other of bores 612 and 616 are offset from their corresponding heating element. The present invention is also well suited to an embodiment in which bore 614 is offset from heating element 604. Furthermore, the present invention is also well suited to an embodiment in which the trajectory of the ejected fluid is other than that shown in the embodiment of FIG. 7A. Although offset bores are used in the present embodiment to achieve an angled trajectory for the ejected fluid, the present invention is also well suited to using various approaches other than offset bores to achieve an angled trajectory for the ejected fluid.

Figure 7B:
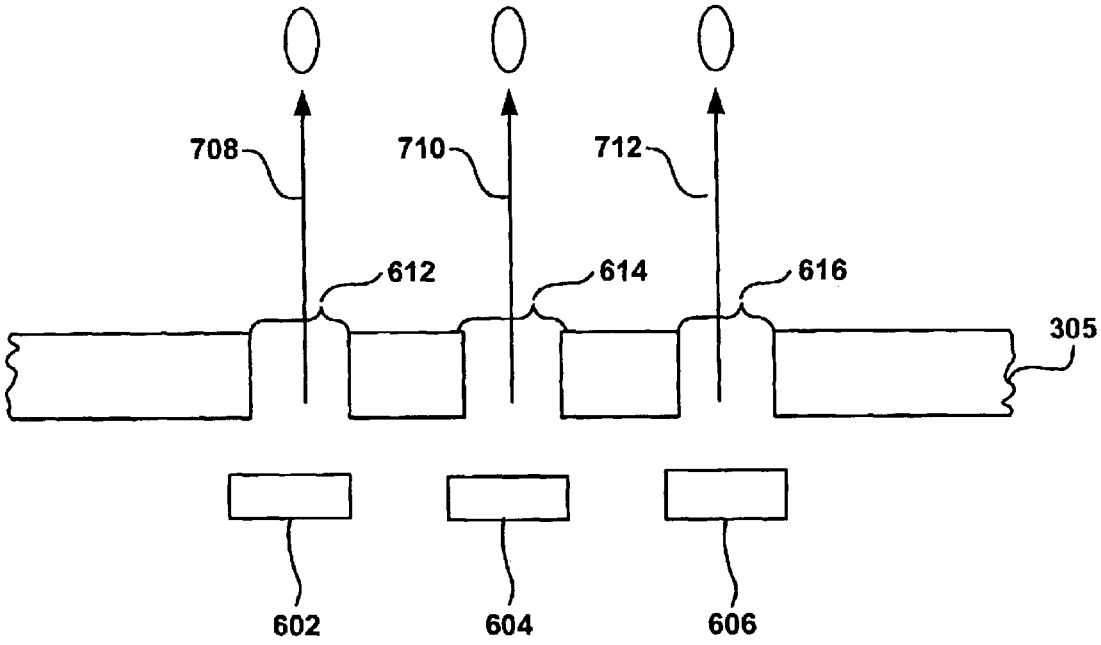
FIG. 7B is a side sectional schematic view of a plurality of heating elements located in a common firing chamber and corresponding bores located proximate to the common firing chamber of a multi-drop weight firing architecture in accordance with various embodiments of the present claimed invention.

With reference now to FIG. 7B, a side sectional schematic view is shown of a plurality of heating elements 602, 604, and 606 located in a common firing chamber, and corresponding aligned bores 612, 614, and 616, respectively, formed through, for example, an orifice layer 305. As shown in FIG. 7B, in one embodiment of the present invention, bores 612, 614, and 616 are disposed aligned with (i.e. centered with respect to) heating element 602, heating element 604, and heating element 606, respectively. In so doing, fluid which heating element 602 causes to be ejected from the common firing chamber is directed along a trajectory as indicated by arrow 708 which is substantially parallel to the trajectory indicated by arrows 710 and 712. Likewise, in the embodiment of FIG. 7B, fluid which heating element 604 causes to be ejected from the common firing chamber is directed along a trajectory as schematically indicated by arrow 710 which is substantially parallel to the trajectory schematically indicated by arrows 708 and 712. Also, in the embodiment of FIG. 7B, fluid which heating element 606 causes to be ejected from the common firing chamber is directed along a trajectory as schematically indicated by arrow 712 which is substantially parallel to the trajectory schematically indicated by arrows 708 and 710. Although each of bores 612, 614, and 616 are disposed in a centered orientation in the present embodiment, the present invention is also well suited to an embodiment in which less than all of bores 612, 614, and 616 are centered with their corresponding heating element.

Figure 8A:
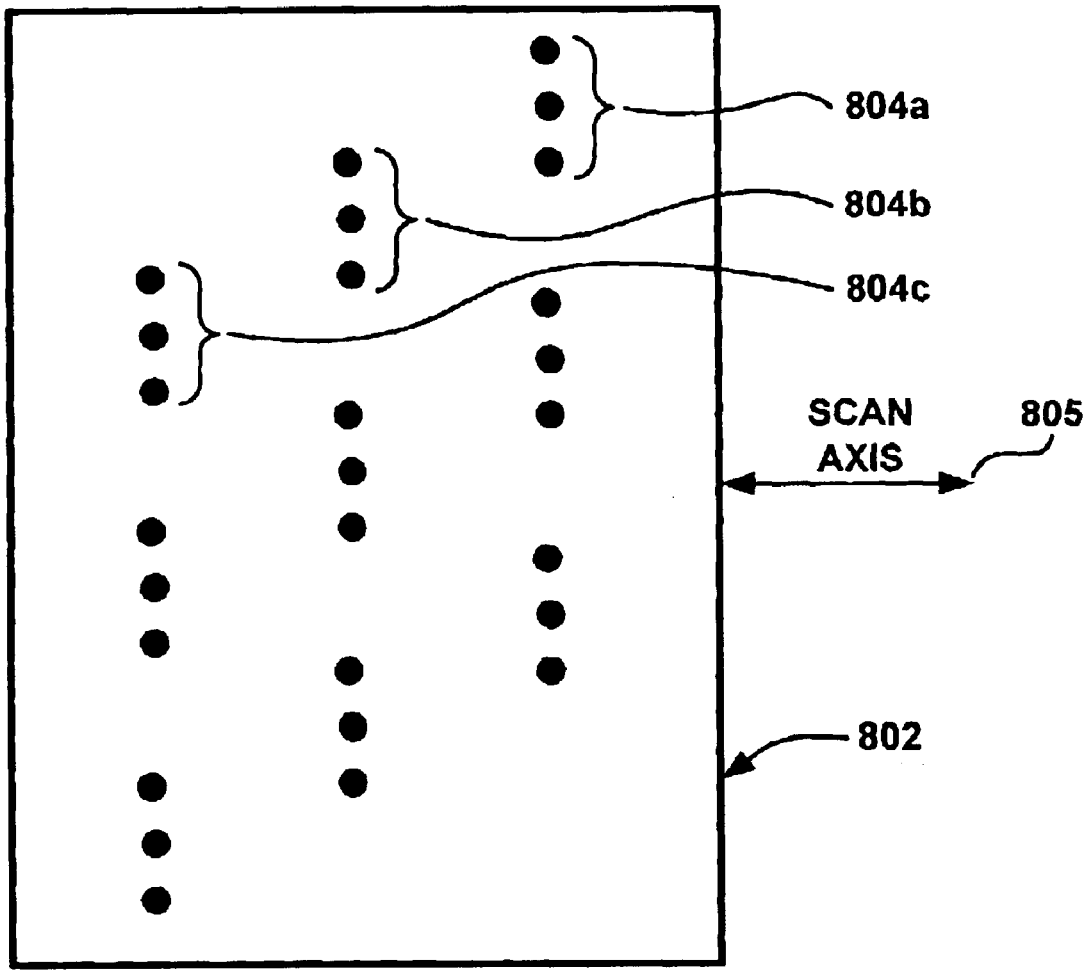
FIG. 8A is a plan view of one orientation of a plurality of bores on a printhead in which a plurality of heating elements are disposed in a common firing chamber in accordance with various embodiments of the present claimed invention.

With reference now to FIG. 8A, a schematic plan view is shown of one orientation of a plurality of bores on a printhead 802 in which a plurality of heating elements are disposed in a common firing chamber in accordance with various embodiments of the present claimed multi-drop weight firing architecture. In the present embodiment, a schematically depicted printhead 802 is shown having an orifice layer with sets of staggered bores 804*a*, 804*b*, and 804*c* arranged thereon. In one embodiment, the sets of staggered bores 804*a*, 804*b*, and 804*c*, correspond to, for example, bores 612, 614, and 616. Although such an orientation is shown in the present embodiment, the present invention is also well suited to various other orientations for the bores. A scan axis 805 is also shown in FIG. 8A for reference.

Figure 8B:
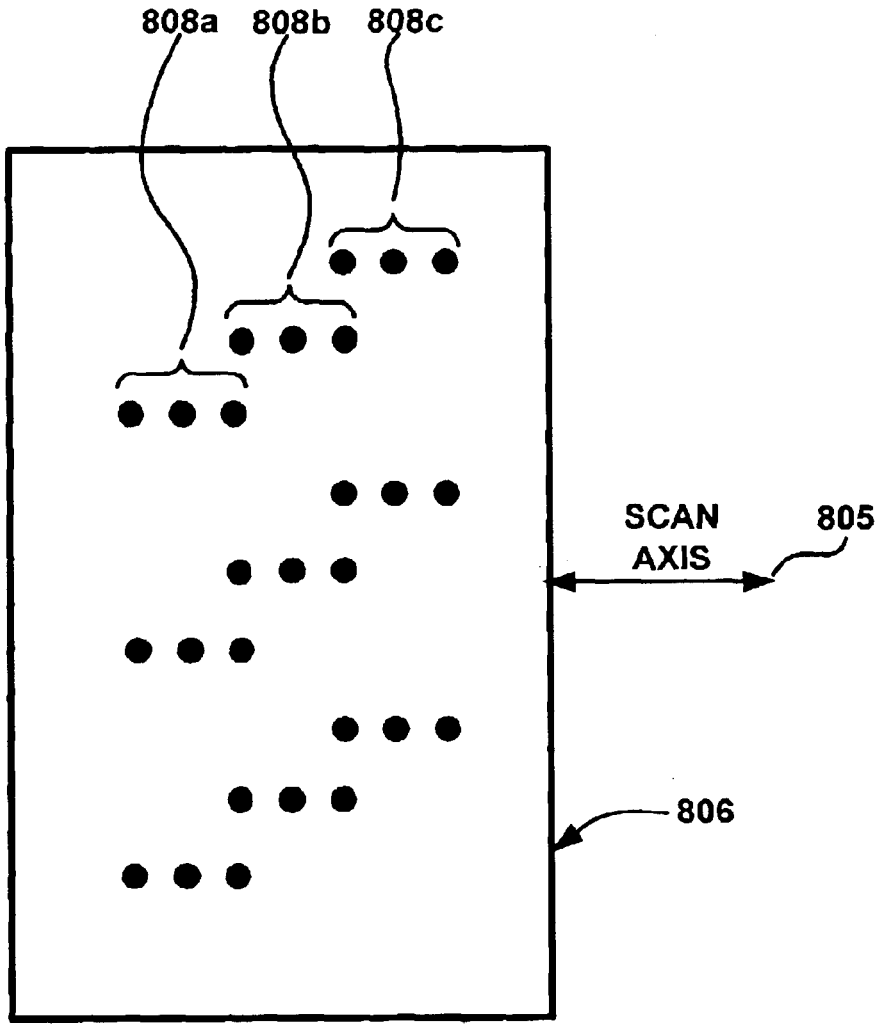
FIG. 8B is a plan view of another orientation of a plurality of bores on a printhead in which a plurality of heating elements are disposed in a common firing chamber in accordance with various embodiments of the present claimed invention.

Referring next to FIG. 8B, a schematic plan view is shown of another orientation of a set of bores in an orifice layer in which a plurality of heating elements are disposed in a common firing chamber in accordance with various embodiments of the present claimed multi-drop weight firing architecture. In the present embodiment, a schematically depicted orifice layer is shown having a set of staggered bores 808*a*, 808*b*, and 808*c* arranged thereon. For example, sets of staggered bores 808*a*, 808*b*, and 808*c*, correspond with, for example, bores 612, 614, and 616. Although such an orientation is shown in the present embodiment, the present invention is also well suited to various other orientations for the bores. A scan axis 805 is also shown in FIG. 8B for reference.

Figure 9:
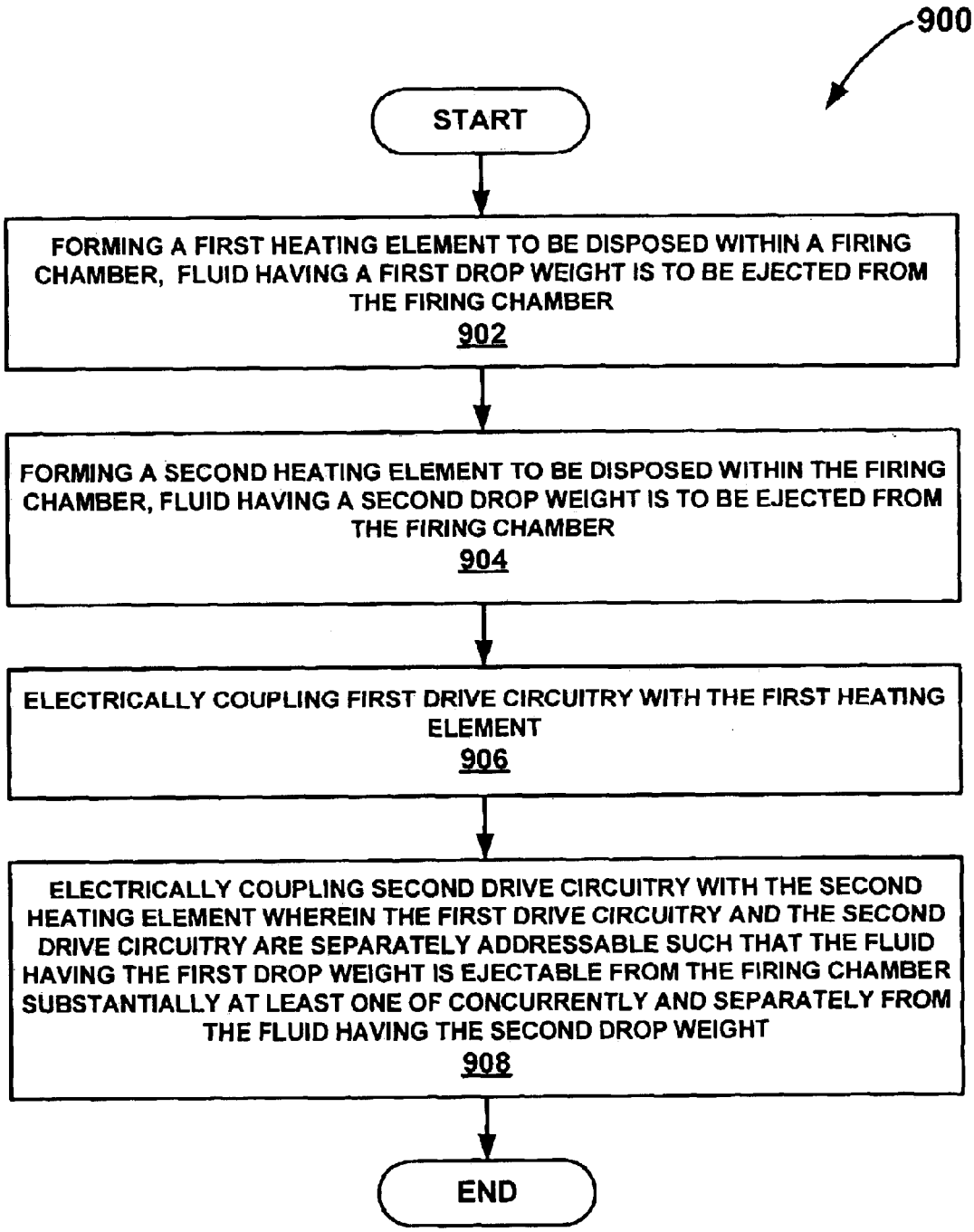
FIG. 9 is a flow chart of steps performed during the manufacturing of a fluid ejection device having a plurality of heating elements located in a common firing chamber and a plurality of drive circuitry located proximate to the common firing chamber in accordance with one embodiment of the present claimed invention.

With reference next to FIG. 9, a flow chart 900 is shown of steps performed during the manufacture of one embodiment of the present multi-drop weight firing architecture. At step 902, the present embodiment forms a first heating element to be disposed within a firing chamber. In this embodiment, and in a manner as was described above in detail in conjunction with the discussion of FIG. 4, fluid having a first drop weight is ejected from a firing chamber.

At step 904, the present embodiment forms a second heating element to be disposed within the same firing chamber in which the first heating element is to be disposed. In the present embodiment, fluid having a second drop weight is ejected from the common firing chamber. In one embodiment of the present invention, the first heating element and the second heating element are formed such that the first drop weight is different than the second drop weight. The present invention is, however, well suited to forming the first heating element and the second heating element such that the first drop weight is the same as the second drop weight.

Referring still to step 904, in one embodiment, the present invention also includes the step of forming a first bore proximate the first heating element, wherein the first bore is disposed to direct fluid having the first drop weight when ejected from the firing chamber. Such an embodiment also typically includes the step of forming a second bore proximate the second heating element, wherein the second bore is disposed to direct fluid having the second drop weight when ejected from the firing chamber. In so doing, the present embodiment is able to direct the fluid having the first drop weight and the fluid having the second drop weight in a desired direction.

Referring now to step 906, the present embodiment then electrically couples first drive circuitry with the first heating element. As was described above in detail, the first drive circuitry is for controlling the first heating element.

With reference now to step 908, the present embodiment then electrically couples second drive circuitry with the second heating element. In this embodiment, the electrical coupling is performed such that, ultimately, the first drive circuitry and the second drive circuitry are separately addressable. In so doing, the fluid having the first drop weight is ejectable from the firing chamber substantially concurrently or separately from the fluid having the second drop weight. As mentioned above, the present embodiment of the multi-drop weight firing architecture is compatible with existing firing chamber, printhead, and printer component fabrication processes. That is, the present embodiment of the multi-drop weight firing architecture can be manufactured using existing fabrication processes and equipment.

Figure 10:
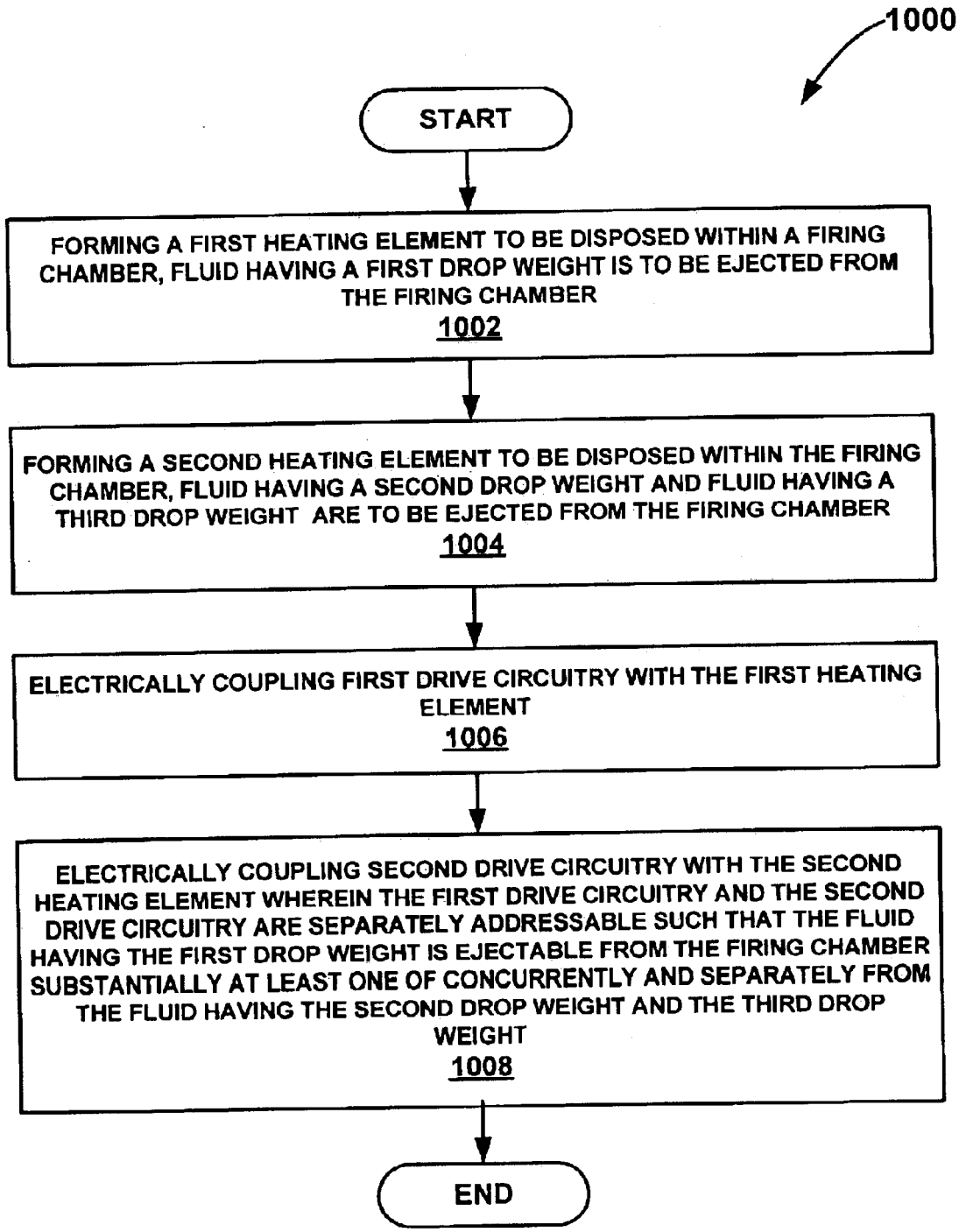
FIG. 10 is a flow chart of steps performed during the manufacturing of a fluid ejection device having a plurality of heating elements located in a common firing chamber and a plurality of drive circuitry located proximate to the common firing chamber in accordance with another embodiment of the present claimed invention.

With reference next to FIG. 10, a flow chart 1000 is shown of steps performed during the manufacture of one embodiment of the present multi-drop weight firing architecture. At step 1002, the present embodiment forms a first heating element to be disposed within a firing chamber. In this embodiment, and in a manner as was described above in detail in conjunction with the discussion of FIG. 6, fluid having a first drop weight is ejected from a firing chamber.

At step 1004, the present embodiment forms a second heating element to be disposed within the same firing chamber in which the first heating element is to be disposed. In the present embodiment, fluid having a second drop weight is ejected from the common firing chamber and also fluid having a third drop weight is ejected from the common firing chamber. In one embodiment of the present invention, the first heating element and the second heating element are formed such that the first drop weight is different than the second and third drop weight combined or individually. The present invention is, however, well suited to forming the first heating element and the second heating element such that the first drop weight is the same as the second and third drop weight combined or individually.

Referring still to step 1004, in one embodiment, the present invention also includes the step of forming a first bore proximate the first heating element, wherein the first bore is disposed to direct fluid having the first drop weight when ejected from the firing chamber. Such an embodiment also typically includes the step of forming a second bore proximate the second heating element and a third bore proximate the third heating element. In such an embodiment, the second bore is disposed to direct fluid having the second drop weight when ejected from the firing chamber and the third bore is disposed to direct fluid having the third drop weight when ejected from the firing chamber. In so doing, the present embodiment is able to direct the fluid having the first drop weight, the second drop weight, and the fluid having the third drop weight in a desired direction.

Referring now to step 1006, the present embodiment then electrically couples first drive circuitry with the first heating element. As was described above in detail, the first drive circuitry is for controlling the first heating element.

With reference now to step 1008, the present embodiment then electrically couples second drive circuitry with the second heating element. In this embodiment, the electrical coupling is performed such that, ultimately, the first drive circuitry and the second drive circuitry are separately addressable. In so doing, the fluid having the first drop weight is ejectable from the firing chamber substantially concurrently or separately from the fluid having the second drop weight and the fluid having the third drop weight. As mentioned above, the present multi-drop weight firing architecture is compatible with existing firing chamber, printhead, and printer component fabrication processes. That is, the present multi-drop weight firing architecture can be manufactured using existing fabrication processes and equipment.

Thus, an embodiment of the present invention provides a firing architecture which is able to efficiently meet the resolution and technological demands of sophisticated printing systems.

The foregoing descriptions of specific embodiments of the present invention have been presented for purposes of illustration and description. They are not intended to be exhaustive or to limit the invention to the precise forms disclosed, and many modifications and variations may be possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A fluid ejection device comprising:

a first drop ejector associated with a firing chamber, said first drop ejector configured to cause fluid having a first drop weight to be ejected from said firing chamber, wherein said first drop ejector includes a first heating element and first drive circuitry electrically coupled with said first heating element;

a first bore disposed within an orifice layer disposed proximate said first drop ejector, said first bore associated with said first drop ejector and disposed to direct said fluid having said first drop weight when ejected from said firing chamber;

a second drop ejector associated with said firing chamber, said second drop ejector configured to cause fluid having a second drop weight to be ejected from said firing chamber, wherein said second drop ejector includes a second heating element and second drive circuitry electrically coupled with said second heating element; and a second bore disposed within said orifice layer disposed proximate said second drop ejector, said second bore associated with said second drop ejector and disposed to direct said fluid having said second drop weight to merge with said fluid having said first drop weight before impacting with a print media.

2. The fluid ejection device of claim 1 wherein said first heating element and said second heating element at least partially define said first drop weight and said second drop weight, respectively.

3. The fluid ejection device of claim 1 wherein said first drive circuitry and said second drive circuitry at least partially define said first drop weight and said second drop weight, respectively.

4. The fluid ejection device of claim 1 wherein said first bore and said second bore at least partially define said first drop weight and said second drop weight, respectively.

5. The fluid ejection device of claim 1 wherein said first drive circuitry and said second drive circuitry are separately addressable such that said fluid having said first drop weight is ejectable from said firing chamber at least one of substantially concurrently and separately from said fluid having said second drop weight.

6. The fluid ejection device of claim 1 wherein said first drop weight is different from said second drop weight.

7. The fluid ejection device of claim 1 wherein said first bore is disposed to direct said fluid having said first drop weight when ejected from said firing chamber; and wherein said second bore is disposed to direct said fluid having said second drop weight when ejected from said firing chamber such that said first bore and said second bore direct said fluid having said first drop weight and said fluid having said second drop weight in a desired direction.

8. The fluid ejection device of claim 1 wherein said second heating element is further configured to cause fluid having a third drop weight to be ejected from said firing chamber.

9. The fluid ejection device of claim 8 wherein said first drop weight, said second drop weight, and said third drop weight are each different.

10. The fluid ejection device of claim 8 wherein said first drive circuitry and said second drive circuitry are separately addressable such that said fluid having said first drop weight is ejectable from said firing chamber at least one of substantially concurrently and separately from said fluid having said second drop weight and said third drop weight.

11. The fluid ejection device of claim 8, wherein said first bore is disposed to direct said fluid having said first drop weight when ejected from said firing chamber; wherein said second bore is disposed to direct said fluid having said second drop weight when ejected from said firing chamber; and a third bore disposed to direct said fluid having said third drop weight when ejected from said firing chamber such that said first bore, said second bore, and said third bore direct said fluid having said first drop weight, said fluid having said second drop weight, and said fluid having said third drop weight in a desired direction.

12. A printhead comprising:

a firing chamber from which fluid is ejected;

a first heating element disposed within said firing chamber and electrically coupled with first drive circuitry, said first heating element configured to cause ejection of fluid having a first drop weight from said firing chamber; and a second heating element disposed within said firing chamber and electrically coupled with second drive circuitry, said second heating element configured to cause ejection of fluid having a second drop weight from said firing chamber, wherein said first drive circuitry and said second drive circuitry are separately addressable such that said fluid having said first drop weight is ejectable from said firing chamber at least one of substantially concurrently and separately from said fluid having said second drop weight;

a first bore disposed within an orifice layer disposed proximate said first heating element and for directing said fluid having said first drop weight when ejected from said firing chamber, said first bore associated with said first heating element; and a second bore disposed within an orifice layer disposed proximate said second heating element and for directing said fluid having said second drop weight to merge with said fluid having said first drop weight before impacting with a print media, said second bore associated with said second heating element.

13. The printhead of claim 12 wherein said first heating element and said second heating element at least partially define said first drop weight and said second drop weight, respectively.

14. The printhead of claim 12 wherein said first drive circuitry and said second drive circuitry at least partially define said first drop weight and said second drop weight, respectively.

15. The printhead of claim 12 wherein said first bore and said second bore at least partially define said first drop weight and said second drop weight, respectively.

16. The printhead of claim 12 wherein said first drop weight is different than said second drop weight.

17. The printhead of claim 12 wherein said first bore is disposed to direct said fluid having said first drop weight when ejected from said firing chamber; and wherein said second bore is disposed to direct said fluid having said second drop weight when ejected from said firing chamber such that said first bore and said second bore direct said fluid having said first drop weight and said fluid having said second drop weight in a desired direction.

18. The printhead of claim 12 wherein said second heating element is further configured to cause fluid having a third drop weight to be ejected from said firing chamber.

19. The printhead of claim 18 wherein said first drop weight, said second drop weight, and said third drop weight are each different.

20. The printhead of claim 18 wherein said first drive circuitry and said second drive circuitry are separately addressable such that said fluid having said first drop weight is ejectable from said firing chamber at least one of substantially concurrently and separately from said fluid having said second drop weight and said third drop weight.

21. The printhead of claim 18 wherein said first bore is disposed to direct said fluid having said first drop weight when ejected from said firing chamber;

wherein said second bore is disposed to direct said fluid having said second drop weight when ejected from said firing chamber; and a third bore is disposed to direct said fluid having said third drop weight when ejected from said firing chamber such that said first bore, said second bore, and said third bore direct said fluid having said first drop weight, said fluid having said second drop weight, and said fluid having said third drop weight in a desired direction.

22. A replaceable printer component comprising:

a substrate;

a firing chamber coupled to said substrate;

means for ejecting fluid disposed within said firing chamber, a first of said means for ejecting configured to cause fluid having a first drop weight to be ejected from said firing chamber, and a second of said means for ejecting configured to cause fluid having a second drop weight to be ejected from said firing chamber;

first drive circuitry electrically coupled with a heating element of said first of said means for ejecting;

a first bore disposed within an orifice layer disposed proximate said first means for ejecting and disposed to direct said fluid having said first drop weight when ejected from said firing chamber, said first bore associated with said first means for ejecting;

second drive circuitry electrically coupled with a heating element of said second of said means for ejecting; and a second bore disposed within said orifice layer disposed proximate said second means for ejecting and disposed to direct said fluid having said second drop weight to merge with said fluid having said first drop weight before impacting with a print media, said second bore associated with said second means for ejecting.

23. The replaceable printer component of claim 22 wherein said heating element of said first of said means for ejecting and said heating element of said second of said means for ejecting at least partially define said first drop weight and said second drop weight, respectively.

24. The replaceable printer component of claim 22 wherein said first drive circuitry and said second drive circuitry at least partially define said first drop weight and said second drop weight, respectively.

25. The replaceable printer component of claim 22 wherein said first bore and said second bore at least partially define said first drop weight and said second drop weight, respectively.

26. The replaceable printer component of claim 22 wherein said first drive circuitry and said second drive circuitry are separately addressable such that said fluid having said first drop weight is ejectable from said firing chamber at least one of substantially concurrently and separately from said fluid having said second drop weight.

27. The replaceable printer component of claim 22 wherein said first drop weight is different from said second drop weight.

28. The replaceable printer component of claim 22 wherein said first bore is disposed to direct said fluid having said first drop weight when ejected from said firing chamber; and wherein said second bore is disposed to direct said fluid having said second drop weight when ejected from said firing chamber such that said first bore and said second bore direct said fluid having said first drop weight and said fluid having said second drop weight in a desired direction.

29. The replaceable printer component of claim 22 wherein said heating element of said second of said ejecting means is further configured to cause fluid having a third drop weight to be ejected from said firing chamber.

30. The replaceable printer component of claim 29 wherein said first drop weight, said second drop weight, and said third drop weight are each different.

31. The replaceable printer component of claim 29 wherein said first drive circuitry and said second drive circuitry are separately addressable such that said fluid having said first drop weight is ejectable from said firing chamber at least one of substantially concurrently and separately from said fluid having said second drop weight and said third drop weight.

32. The replaceable printer component of claim 29 wherein said first bore is disposed to direct said fluid having said first drop weight when ejected from said firing chamber;

wherein said second bore is disposed to direct said fluid having said second drop weight when ejected from said firing chamber; and a third bore is disposed to direct said fluid having said third drop weight when ejected from said firing chamber such that said first bore, said second bore, and said third bore direct said fluid having said first drop weight, said fluid having said second drop weight, and said fluid having said third drop weight in a desired direction.

33. A method of manufacturing a fluid ejection device comprising:

forming a first drop ejector to be associated with a firing chamber, said first drop ejector for causing fluid having a first drop weight to be ejected from said firing chamber;

forming a second drop ejector to be associated with said firing chamber, said second drop ejector for causing fluid having a second drop weight to be ejected from said firing chamber;

forming a first bore associated with said first drop ejector, said first bore disposed to direct said fluid having said first drop weight when ejected from said firing chamber;

forming a second bore associated said second drop ejector, said second bore disposed to direct said fluid having said second drop weight to merge with said fluid having said first drop weight before impacting with a print media;

electrically coupling first drive circuitry with a heating element of said first drop ejector; and electrically coupling second drive circuitry with a heating element of said second drop ejector wherein said first drive circuitry and said second drive circuitry are separately addressable such that said fluid having said first drop weight is ejectable from said firing chamber at least one of substantially concurrently and separately from said fluid having said second drop weight.

34. The method of manufacturing a fluid ejection device as recited in claim 33 wherein said heating element of said first drop ejector and said heating element of said second drop ejector at least partially define said first drop weight and said second drop weight, respectively.

35. The method of manufacturing a fluid ejection device as recited in claim 33 wherein said first drive circuitry and said second drive circuitry at least partially define said first drop weight and said second drop weight, respectively.

36. The method of manufacturing a fluid ejection device as recited in claim 33 wherein said first bore and said second bore at least partially define said first drop weight and said second drop weight, respectively.

37. The method of manufacturing a fluid ejection device as recited in claim 33 comprising:

forming said heating element of said first drop ejector and forming said heating element of said second drop ejector such that said first drop weight is different than said second drop weight.

38. The method of manufacturing a fluid ejection device as recited in claim 33 further comprising:

forming said first bore oriented to direct said fluid having said first drop weight when ejected from said firing chamber;

forming said second bore oriented to direct said fluid having said second drop weight when ejected from said firing chamber such that said first bore and said second bore direct said fluid having said first drop weight and said fluid having said second drop weight in a desired direction.

39. The method of manufacturing a fluid ejection device as recited in claim 33 further comprising:

forming said heating element of said second drop ejector such that said second drop ejector causes fluid having a third drop weight to be ejected from said firing chamber.

40. The method of manufacturing a fluid ejection device as recited in claim 39 wherein said first drop weight, said second drop weight, and said third drop weight are each different.

41. The method of manufacturing a fluid ejection device as recited in claim 39 comprising:

forming said first drive circuitry and said second drive circuitry to be separately addressable such that said fluid having said first drop weight is ejectable from said firing chamber at least one of substantially concurrently and separately from said fluid having said second drop weight and said third drop weight.

42. The method of manufacturing a fluid ejection device as recited in claim 39 further comprising:

forming said first bore proximate said heating element of said first drop ejector, said first bore disposed to direct said fluid having said first drop weight when ejected from said firing chamber;

forming said second bore proximate said heating element of said second drop ejector, said second bore disposed to direct said fluid having said second drop weight when ejected from said firing chamber; and forming a third bore proximate said heating element of said second drop ejector, said third bore disposed to direct said fluid having said third drop weight when ejected from said firing chamber such that said first bore, said second bore, and said third bore direct said fluid having said first drop weight, said fluid having said second drop weight, and said fluid having said third drop weight in a desired direction.

43. A fluid ejection device having dynamically selectable drop weights, said fluid ejection device comprising:

a first drop ejector associated with a firing chamber, said first drop ejector configured to cause fluid having a first drop weight to be ejected from said firing chamber, said first drop ejector having a first bore disposed to direct said fluid having said first drop weight when ejected from said firing chamber associated therewith;

first drive circuitry electrically coupled with a heating element of said first drop ejector for dynamically selecting said first drop weight;

a second drop ejector associated with said firing chamber, said second drop ejector configured to cause fluid having a second drop weight to be ejected from said firing chamber, said second drop ejector having a second bore disposed to direct said fluid having said second drop weight to merge with said fluid having said first drop weight before impacting with a print media associated therewith; and second drive circuitry electrically coupled with a heating element of said second drop ejector for dynamically selecting said second drop weight, said first drive circuitry and said second drive circuitry separately addressable such that fluid having said first drop weight, said second drop weight or both said first drop weight and said second drop weight can be dynamically selected to be ejected from said firing chamber.

44. The fluid ejection device having dynamically selectable drop weights of claim 43 wherein said heating element of said first drop ejector and said heating element of said second drop ejector at least partially define said first drop weight and said second drop weight, respectively.

45. The fluid ejection device having dynamically selectable drop weights of claim 43 wherein said first drive circuitry and said second drive circuitry at least partially define said first drop weight and said second drop weight, respectively.

46. The fluid ejection device having dynamically selectable drop weights of claim 43 wherein said first bore and said second bore at least partially define said first drop weight and said second drop weight, respectively.

47. The fluid ejection device having dynamically selectable drop weights of claim 43 wherein said first drop weight is different from said second drop weight.

48. The fluid ejection device having dynamically selectable drop weights of claim 43 further comprising:

said first bore disposed to direct said fluid having said first drop weight when ejected from said firing chamber; and said second bore disposed to direct said fluid having said second drop weight when ejected from said firing chamber such that said first bore and said second bore direct said fluid having said first drop weight and said fluid having said second drop weight in a desired direction.

49. The fluid ejection device having dynamically selectable drop weights of claim 43 wherein said heating element of said second drop ejector is further configured to cause fluid having a third drop weight to be ejected from said firing chamber.

50. The fluid ejection device having dynamically selectable drop weights of claim 49 wherein said first drop weight, said second drop weight, and said third drop weight are each different.

51. The fluid ejection device having dynamically selectable drop weights of claim 49 wherein said first drive circuitry and said second drive circuitry are separately addressable such that fluid having said first drop weight, said second and third drop weight or both said first drop weight and said second and said third drop weight can be dynamically selected to be ejected from said firing chamber.

52. The fluid ejection device having dynamically selectable drop weights of claim 49 further comprising:

said first bore disposed to direct said fluid having said first drop weight when ejected from said firing chamber;

said second bore disposed to direct said fluid having said second drop weight when ejected from said firing, a third bore disposed to direct said fluid having said third drop weight when ejected from said firing chamber such that said first bore, said second bore, and said third bore direct said fluid having said first drop weight, said fluid having said second drop weight, and said fluid having said third drop weight in a desired direction.

* * * * *